US006058922A

United States Patent [19]

Sexton

[11] Patent Number: 6,058,922

[45] Date of Patent: May 9, 2000

[54] GRINDING BLADE FOR TROWEL MACHINE

[76] Inventor: Marvin P. Sexton, 6022 Six Mile La., Louisville, Ky. 40218

[21] Appl. No.: 09/225,030

[22] Filed: Jan. 4, 1999

[51] Int. Cl.[7] ..... B28D 1/04

[52] U.S. Cl. ..... 125/13.01; 125/30.01; 451/350; 451/353

[58] Field of Search ..... 451/28, 64, 65, 451/66, 69, 344, 350, 353, 354, 540, 548, 550, 529; 125/13.01, 30.01, 36, 38, 20, 25, 26

[56] References Cited

U.S. PATENT DOCUMENTS

| | | | |
|---|---|---|---|
| 2,865,269 | 12/1958 | McMillan . | |
| 2,869,441 | 1/1959 | Barnes . | |
| 3,259,033 | 7/1966 | Kelley . | |
| 3,269,283 | 8/1966 | Grub . | |
| 3,375,766 | 4/1968 | Zochil . | |
| 3,683,761 | 8/1972 | Babic . | |
| 3,721,048 | 3/1973 | Rand | 451/350 |
| 3,732,590 | 5/1973 | Horst . | |
| 4,046,483 | 9/1977 | Sutherland . | |
| 4,232,980 | 11/1980 | Tertinek . | |
| 4,312,603 | 1/1982 | Whiteman . | |
| 4,775,306 | 10/1988 | Kikuchi et al. . | |
| 4,848,960 | 7/1989 | Kajioka et al. . | |
| 5,762,545 | 6/1998 | Edwards | 451/353 |

*Primary Examiner*—Derris Holt Banks
*Attorney, Agent, or Firm*—Middleton & Reutlinger; John F. Salazar

[57] ABSTRACT

The present invention is directed towards an attachment to a trowel machine. The trowel machine attachment converts the trowel machine blade to a grinding blade and allows the trowel machine to become a grinding machine in order to smooth the concrete surface. If the concrete surface has dried to such an extent that a trowel machine will not adequately smooth the concrete surface, the attachment converts the trowel blades to grinding blades and allows the concrete to be smoothed even though it has hardened. The attachment depends directly below the trowel blade and has a grinding stone which extends directly therebelow. The attachment securely attaches to the trowel blade by receiving the blade within a reservoir and additionally has an attachment clip in order to maintain the grinding blade attachment directly to the trowel blade. The attachment of the present invention allows a trowel machine to easily and quickly be converted to a grinding machine.

17 Claims, 4 Drawing Sheets

GRINDING BLADE FOR TROWEL MACHINE

BACKGROUND OF THE INVENTION

1. Field of the Invention

The present invention relates to finishing machines for concrete and particularly to blades which allow poured and partially dried concrete to be properly finished with a smooth surface. More particularly, the present invention relates to attachments to pre-existing trowel machines which allow the trowel machines to be converted into grinding machines thereby allowing the trowel machine to grind hardened concrete to a smooth finish.

2. Description of the Prior Art

In pouring wet concrete, several steps are required to insure a smooth concrete surface finish after the concrete has partially dried. When the concrete is still in semi-fluid form, it is initially screeded through the use of a screed board or long wooden plank. Screeding is required to bring the wet concrete surface to a roughly equal height. Once the concrete is initially set at this height, the surface of the concrete is then treated with a float. The floating operation is used to settle large stones, smooth out the surface of the wet concrete and settle the larger stones in the concrete below the surface. After the float operation is performed, the concrete has partially dried and the freshly poured concrete may be troweled in order to bring the surface to a smooth finish.

Utilizing a trowel machine with a plurality of blades, the surface of the concrete which is in a partially dried condition is contacted by the rotating blades of the machine and produces a smooth finish surface on the concrete which is free of bubbles and also allows for evaporation of water which may rise to the surface. However, troweling needs to be completed prior to the concrete becoming too hard. Once the freshly poured concrete has hardened, the troweling machine and its corresponding flat blades will not sufficiently smooth the concrete surface. If the freshly poured concrete has hardened to such an extent that the trowel blade or troweling machine will not properly work the concrete surface, a grinding stone is utilized to adequately smooth the concrete. A completely separate machine is utilized for grinding the surface and these machines contact the surface of the poured concrete with a grinding stone. A grinding machine operates to automatically smooth the surface with these rough grinding stones and the machine design has historically been different from the troweling machine due to the moving characteristics of the grinding stone and the like. As a result, the concrete finisher must have both a troweling machine and a grinding machine nearby in case the concrete hardens to such an extent that the trowel machine will not adequately smooth the surface of the poured concrete. It is therefore desirable for the concrete finisher to have on hand an apparatus allowing the conversion of a troweling machine to a grinding machine so that the overhead of having the two aforementioned machines is not necessary.

SUMMARY OF THE INVENTION

It is accordingly an object of the present invention to provide a method for converting a troweling machine to a grinding machine. It is also an object of the present invention to make such a conversion as easy as possible such that the operator may quickly convert the troweling machine and trowel blades to a grinding machine which will adequately and properly grind down the surface of the freshly poured concrete to a smooth finish.

It is further object of the present invention to provide a trowel blade attachment, said trowel blade attachment having a grinding stone at its lower surface to contact the concrete and which is thereby driven by the driving force of the trowel machine.

The apparatus of the present invention includes a grinding stone surface for contacting the surface of the poured concrete. This grinding stone is sufficiently hard enough to act upon the concrete while additionally smoothing the surface without causing significant negative effects. The stone has a substantially rectangular surface which is attached to a base plate. This base plate is securely affixed to the bottom surface of the trowel blade by two methods. First, the trowel blade is inserted into a longitudinal channel, or recess design to receive the blade. Second, the base plate has a pressure clip for attachment to the outwardly extending arm or block of the trowel machine. This design allows the operator of a trowel machine to convert the machine to a grinding apparatus for those occasions when it is necessary to grind down the surface of the concrete.

DESCRIPTION OF THE PREFERRED EMBODIMENT

Figure 1:
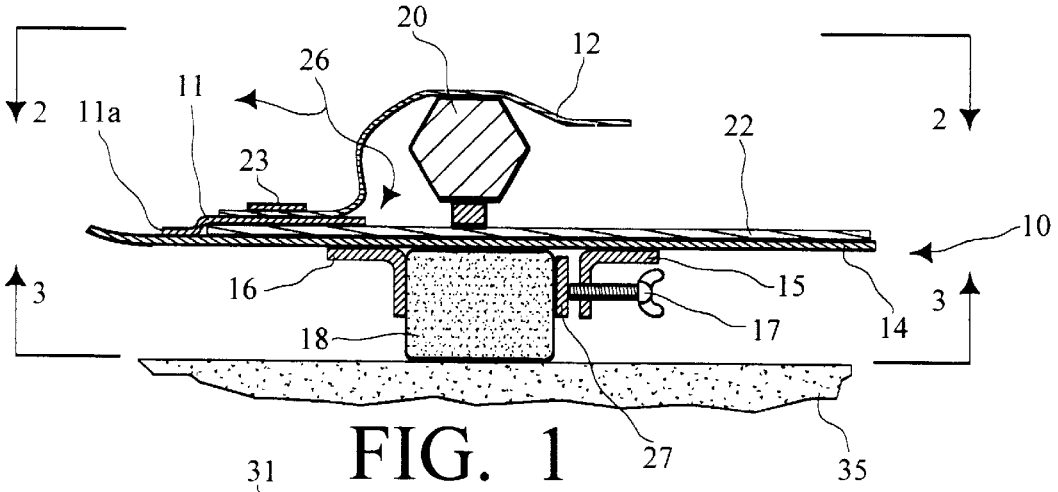
FIG. 1 is a sectional view of the trowel machine grinding blade attachment of the present invention attached to a trowel machine blade.
Figure 4:
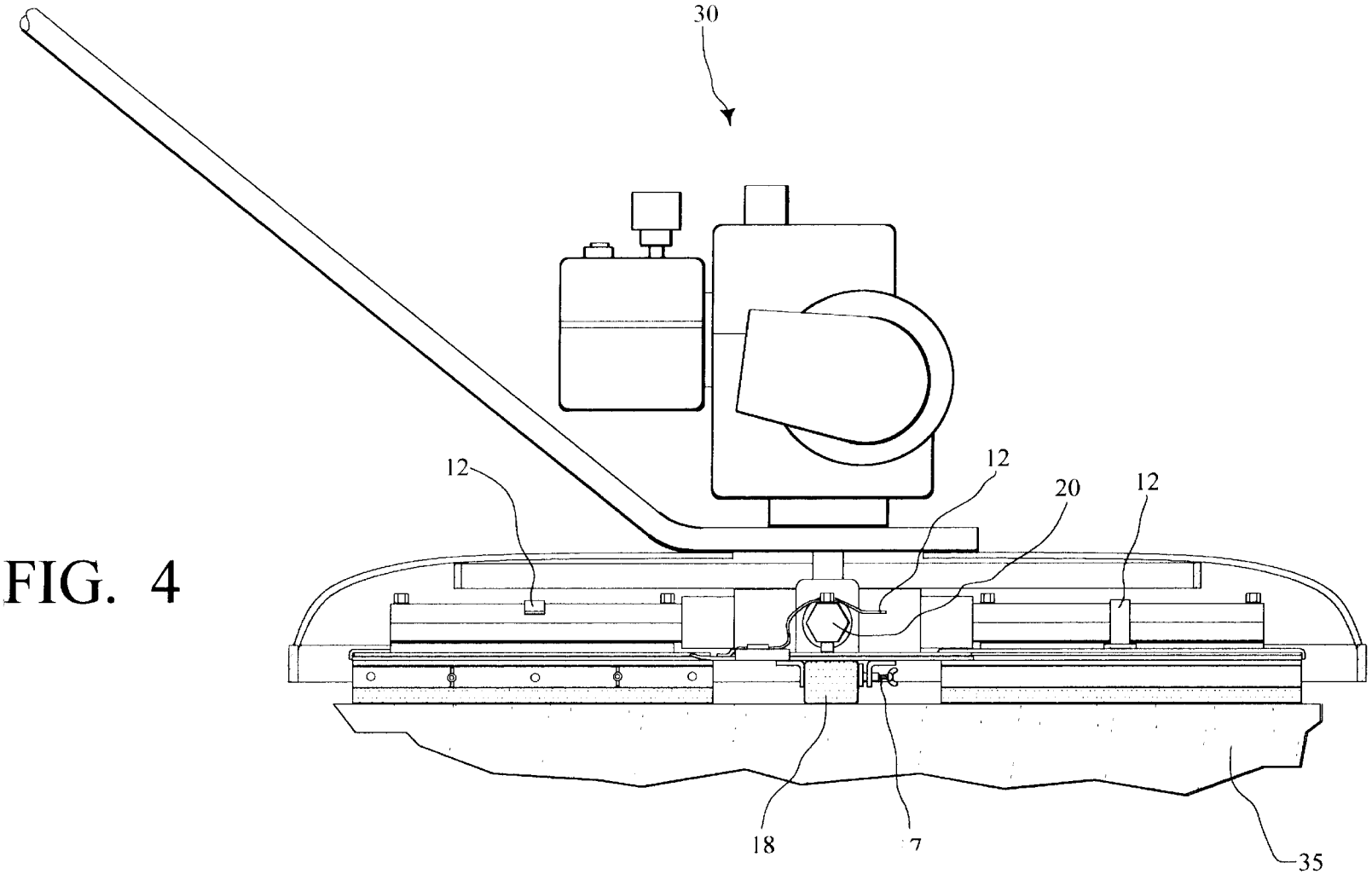
FIG. 4 is a side view of a trowel machine which has the grinding blades of FIG. 1 attached thereto; and, FIG. 5 is a side view of an alternative embodiment for the present invention.

The trowel machine grinding blade attachment 10 is shown in FIG. 1. The grinding blade attachment 10 suspends directly below a trowel blade 22 which is connected to the trowel machine by the outwardly extending attachment arm 20. Referring to FIG. 4, the attachment arm 20 retains the trowel blade 22 therebelow. Trowel blade 22 of the machine 30 provides an adequate contacting and engagement surface for the grinding blade attachment 10. The grinding stone 18 contacts the concrete surface and depends below the base plate 14 which itself is directly below the trowel blade 22.

Figure 2:
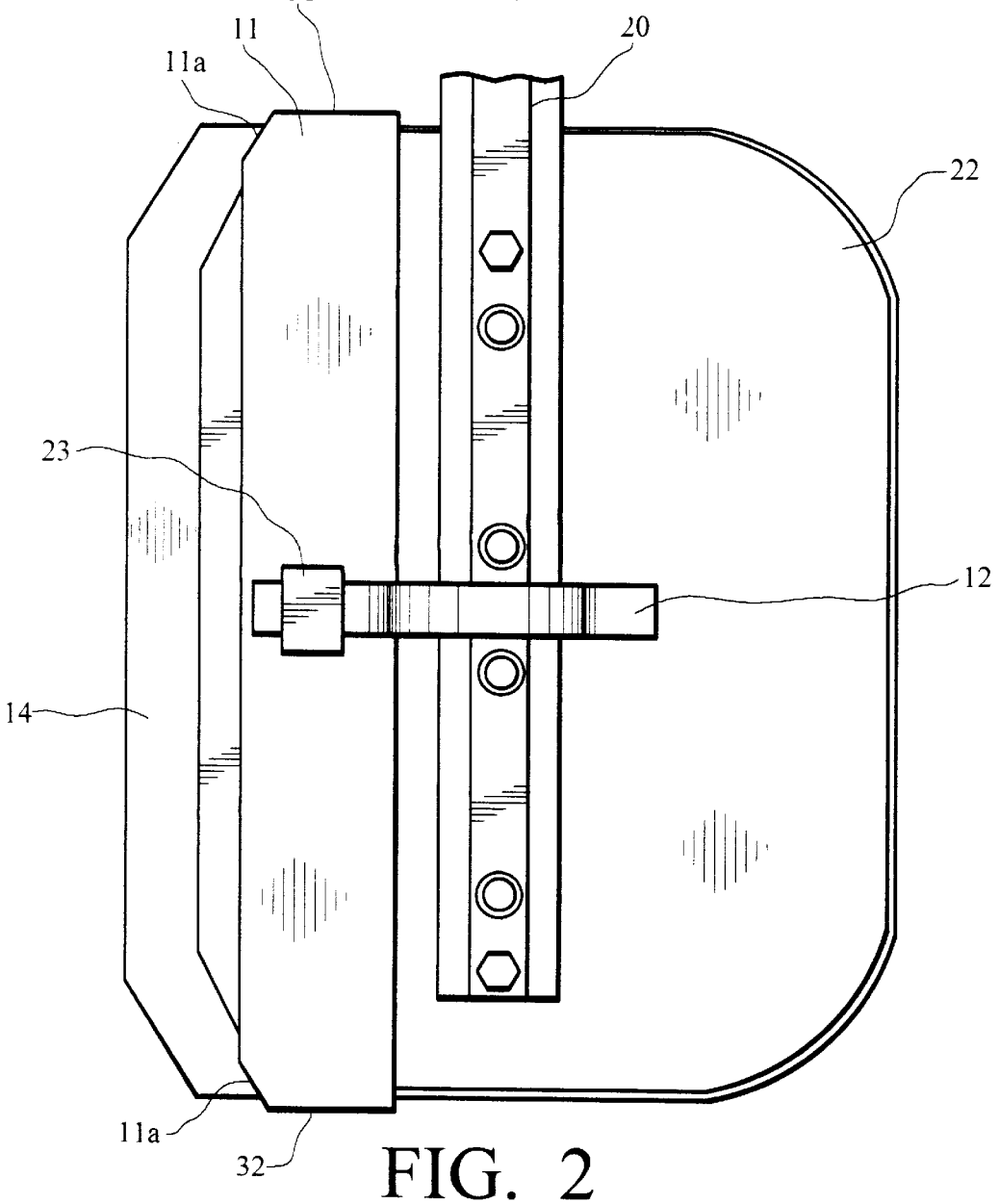
FIG. 2 is a top view of the trowel machine grinding blade shown in FIG. 1.

The trowel machine 30 prior to attachment of the grinding blade 10, has a trowel blade 22 which is attached directly to the attachment arm 20 via bolts or other connecting means not shown. In order to convert the trowel machine to a grinding machine, a grinding blade attachment 10 is securely affixed to each of the trowel blades 22. Typically there are four trowel blades which work the surface of the concrete. The grinding blade attachment 10 has a flat base plate 14 which has a sleeve 11 along a portion of its upper surface. The sleeve 11 is attached to the base plate at first and second end edges 31 and 32 which depend downwardly from the sleeve surface 11 and contact the upper surface of the base plate 14. As is shown in FIG. 2 in this embodiment, sleeve 11 has an open back edge not affixed to the base plate 14. Between the sleeve 11 and the base 14 is an enclosed area 26 for insertion of the leading edge of the trowel blade 22. This allows the entirety of the trowel machine grinding blade edge 10 to be securely retained by each trowel blade 22 so that upon rotation of the trowel blade 22 by the machine 30 the grinding stone 18 is securely affixed thereto and evenly driven. This is especially so since the trowel blade is driven forward into the enclosed area 26 of the trowel machine attachment 10 causing the attachment to be more securely held the more resistance the grinding stone 18 meets.

The grinding blade attachment 10 is comprised of multiple pieces. First, as indicated above, a substantially rectangular base plate 14 provides the major surface upon which the grinding stone 18 and clamping attachment arm 12 are affixed. The grinding stone 18 depends below the bottom surface of the base plate 14 and is held into place by L-shaped support brackets 15 and 16, shown in FIG. 1. Brackets 15 and 16 may be securely attached to the bottom side of the base plate 14, typically through welding or other means, and produce a channel therebetween. The grinding stone 18 fits longitudinally between the supports 15 and 16 and is compressed against support 16 by wing nut 17 or other compression means. A plurality of wing nuts 17 may be provided in order to securely attach and compress the grinding stone 18 against the support bracket 16. Contacting the opposite ends of the wing nuts 17 and 17*a* shown in FIG. 3, a pressure plate 27 may be provided so that the wing nuts do not directly compress against the grinding stone 18 and such that the pressure applied thereto is evenly distributed.

Figure 5:
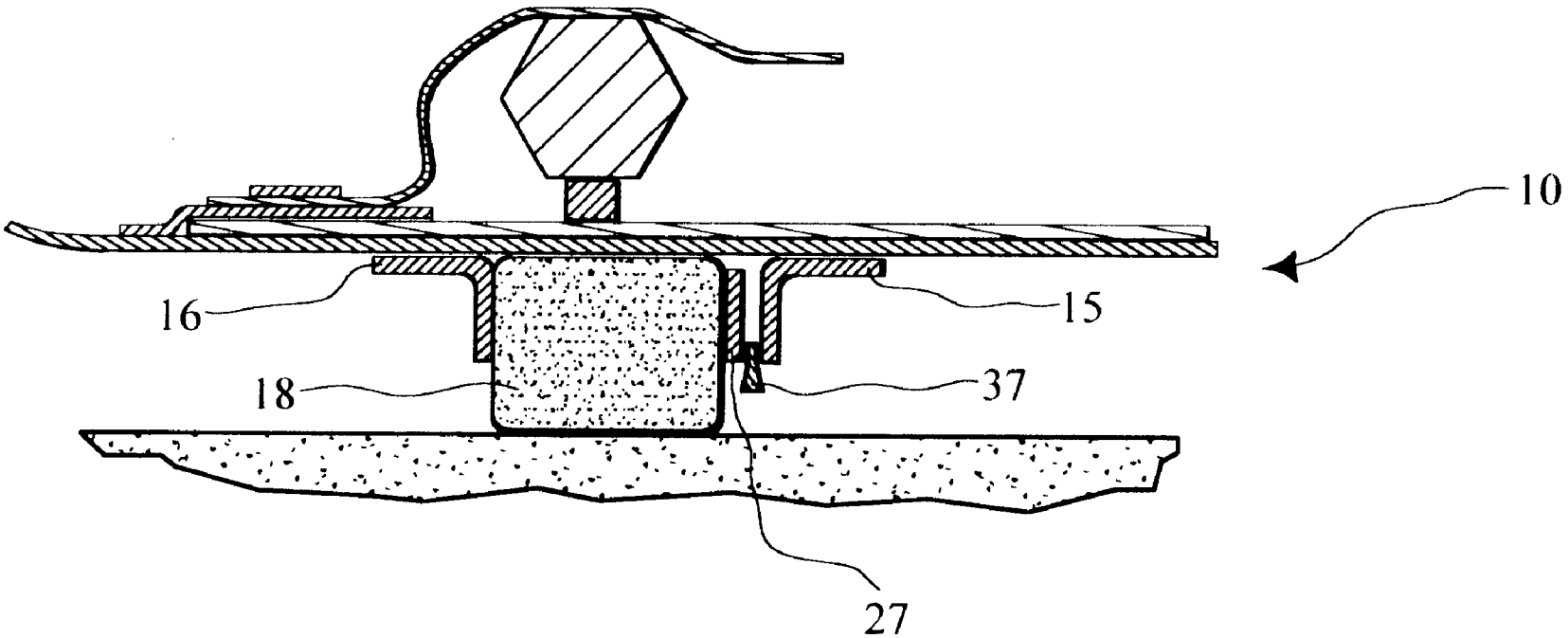

Alternatively, as shown in FIG. 5, wing nuts may be replaced with a simple wedge piece 37 which forces the grinding stone 18 against the L-shaped bracket 16. By compressing the wedge 37 between plate 27 and bracket 15. Wooded wedges are typically used in standard grinding machines to hold grinding stones in place and similar function may be used on the present invention.

Figure 3:
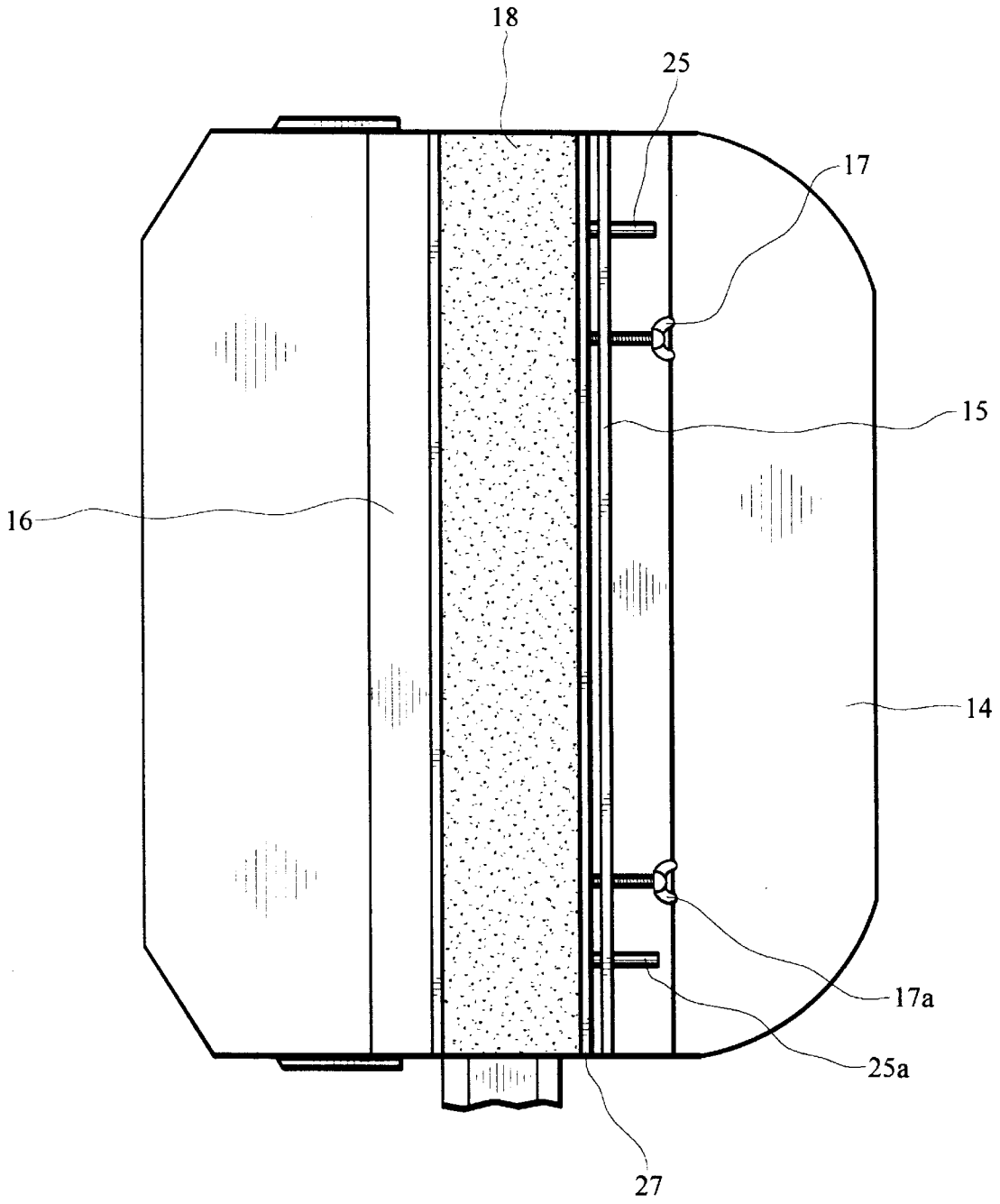
FIG. 3 is a bottom view of the grinding blade shown in FIG. 1.

Also shown in FIG. 3, the grinding stone 18 rests between the brackets 15 and 16 and wing nuts 17 and 17*a* compress against plate 27 in order not to damage the grinding blade 18. Wing nuts 17 and 17*a* extend inward from the bracket 15 and force the stone 18 against bracket 16. Brackets 15 and 16 and the bottom surface of base plate 14 provide a roughly U-shaped channel within which the grinding stone 18 is received. In order to keep the grinding stone 18 centrally aligned therein, guide posts 25 and 25*a* may be provided which extend outwardly from the plate 27 or stone 18 and which would fit through apertures formed within bracket 15 as is shown in FIG. 3. However, depending upon the effectiveness of the wing nuts 17 and 17*a* and the number of attachment points within the above defined channel, guide posts 25 and 25*a* may not be required.

Along the upper surface of base plate 14 is sleeve 11. A small opening or recess 26 between sleeve 11 and the top surface of the base plate 14 exists in order to receive the trowel blade 22 of the trowel machine 30. As can be seen from FIG. 1, sleeve 11 has two back corner walls 11*a*, shown in FIG. 2, which contacts the front edge of the trowel blade 22. Since trowel blade 22 may be somewhat angled along its front edge, a portion of the front edge of the trowel blade 22 will pass through the back wall 11*a* while the comers will contact comers 11*a* of the sleeve 11. This ensures a snug fit of the trowel blade 22 in recess 26 and also allowing the attachment 10 to be securely affixed to the troweling machine 30. Additionally, sleeve 11 angles slightly downward from back wall 11*a* towards the opening of the recess 26 such that the height of the recess 26 is slightly greater at the end nearest the wall 11*a* as opposed to the opening area. This allows the trowel blade 22 to be securely inserted within the recess 26.

As seen in FIGS. 1 and 2, the trowel blade attachment 10 has an attachment arm 12 affixed to the upper surface of the sleeve 11. The arm 12 is a spring like compression device which allows the attachment 10 to be additionally secured to the trowel blade 22. Attachment arm 12 is affixed to the sleeve 11 by attachment block 23 and may be welded thereto. As shown in the embodiment of FIG. 2, the attachment arm 12 fits through the attachment block 23, itself secured to the top surface of the sleeve 11. Alternative methods of attaching the spring like arm 12 to the upper surface of the sleeve may also be utilized and selection of such attachment means is well within the determination of one of ordinary skill in the art.

Attachment arm 12 acts as a compression clip in order to ride over the arm 20 of the trowel machine and affix the grinding blade attachment 10 thereto. By providing for the insertion of the trowel blade 22 into aperture 26 which extends along the upper surface of the base plate 14 in addition to providing for the attachment arm 12 to compress down onto the arm 20 of the trowel machine 30, the grinding blade attachment 10 is thereby securely affixed to the trowel blade 22 and prevents it from becoming loosened during operation of the trowel machine 30. This attachment configuration is shown in FIG. 2.

As shown in FIG. 1, the grinding stone 18 may be completely removed from the grinding blade attachment 10 by unthreading of the wing nuts 17 and 17*a* . During operation of the trowel machine 30, the grinding stone 18 directly contacts the concrete 3 5 and wears the stone down sufficiently to eventually require replacement thereof. The design of the present grinding blade attachment 10 allows the grinding stones to be periodically replaced or turned when required. During use, the stone 18 may wear at an angle such that an even wearing down of the stone 18 may only be accomplished by rotating the stone 180°. The grinding stone 18 is made of either vetrified clay with resin bonding or diamond abraised steel. The arm 20 of the trowel machine rotates in the forward direction thereby forcing the trowel blade against the sleeve 11 and maintaining the attachment 10 in a secure position. This configuration is shown in FIG. 4 wherein the plurality of arms 20 rotate in the clockwise direction under the drive motor of the trowel machine 30.

Utilization of the trowel machine grinding blade 10 of the present invention allows the operator of a trowel machine to convert the machine to a grinding machine and sufficiently smooth the concrete once it is dried too much for action by a standard trowel machine. Through use of the herein described trowel machine grinding blade attachment 10, a smooth finish may be provided to the concrete without use of an additional piece of machinery.

What is claimed is:

1. A grinding blade for a trowel machine, comprising:

a base plate having an upper and lower surface, said lower surface having a grinding stone depending from said lower surface, said upper surface having a sleeve thereon and receiving a trowel blade within said sleeve.

2. The grinding blade of claim 1 wherein said base plate is substantially rectangular.

3. The grinding blade of claim 1 wherein said sleeve has a first and second end edge depending downwardly therefrom, each of said edges attached to said upper surface of said base plate.

4. The grinding blade of claim 3 wherein said end edges form a recess between said sleeve and said base plate.

5. The grinding blade of claim 1 wherein said sleeve has a U-shaped attachment clip affixed thereto.

6. The grinding blade of claim 5 wherein said U-shaped clip may be adapted to wrap around and compress against an outwardly extending attachment arm of a trowel machine.

7. The grinding blade of claim 1 wherein said lower surface of said base plate has a first and a second attachment bracket between which said grinding stone is securely affixed.

8. The grinding blade of claim 7 wherein said first and second attachment brackets are substantially L-shaped and extend along the length of the lower surface of said base plate.

9. The grinding blade of claim 7 wherein said first attachment bracket has a threaded screw threaded therethrough compressing against said grinding stone.

10. The grinding blade of claim 7 wherein said grinding stone has a pressure plate extending along one surface thereof adjacent to said first attachment bracket.

11. The grinding blade of claim 10 wherein said pressure plate has at least one guide posts extending outward therefrom and wherein said first bracket has at least one aperture for receiving said guide posts.

12. The grinding blade of claim 7 wherein said grinding stone is held into place by a wedge inserted between one of said attachment brackets.

13. The grinding blade of claim 1 wherein said grinding stone is removably attached to said bottom surface of said base plate.

14. The grinding blade of claim 1 wherein said blade may be removably attached to a trowel blade of a trowel machine.

15. The grinding blade of claim 14 wherein said blade may be removably attached to said a trowel blade by inserting said trowel blade into said sleeve.

16. The grinding blade of claim 1 wherein said grinding stone is made of vetrified clay having a resin bonding.

17. The grinding blade of claim 1 wherein said grinding stone is made of diamond abraised on steel.

* * * * *